US005690888A

United States Patent [19]

Robert

[11] Patent Number: 5,690,888

[45] Date of Patent: Nov. 25, 1997

[54] APPARATUS AND METHOD FOR TAPPING A REACTOR CONTAINING A MOLTEN FLUID

[75] Inventor: Edgar J. Robert, Glenshaw, Pa.

[73] Assignee: Molten Metal Technologies, Inc., Waltham, Mass.

[21] Appl. No.: 479,508

[22] Filed: Jun. 7, 1995

[51] Int. Cl.[6] ..... C21B 7/12

[52] U.S. Cl. ..... 266/45; 266/239; 222/590; 222/593

[58] Field of Search ..... 266/45, 236, 239; 222/590, 593, 592, 594

[56] References Cited

U.S. PATENT DOCUMENTS

| | | | |
|---|---|---|---|
| 2,568,578 | 9/1951 | Bennett | 266/239 |
| 3,974,698 | 8/1976 | Scott, Jr. | 73/425.6 |
| 5,203,910 | 4/1993 | Areaux et al. | 75/708 |
| 5,224,985 | 7/1993 | Kullik et al. | 75/574 |
| 5,238,484 | 8/1993 | Pirklbauer et al. | 75/414 |
| 5,407,000 | 4/1995 | Mercer, II et al. | 164/457 |

FOREIGN PATENT DOCUMENTS

| | | | |
|---|---|---|---|
| 0197347 | 11/1984 | Japan | 266/239 |
| 404080514 | 3/1992 | Japan | 266/239 |
| 1434617 | 5/1976 | United Kingdom . | |
| WO 92/03240 | 3/1992 | WIPO . | |
| WO93/16829 | 9/1993 | WIPO . | |
| WO 96/06319 | 2/1996 | WIPO . | |

*Primary Examiner*—Scott Kastler

*Attorney, Agent, or Firm*—Hamilton, Brook, Smith & Reynolds, P.C.

[57] ABSTRACT

An apparatus and method for tapping a reactor containing a molten fluid are disclosed. A conduit extending from the reactor is heated to a temperature which causes fluid extracted from the reactor to remain molten while in the conduit. Molten fluid is removed from the reactor by reducing the pressure in a receiving vessel attached to the conduit. As the pressure is reduced in the receiving vessel, molten fluid flows out of the reactor and into and through the conduit, discharging into the receiving vessel. The flow of molten fluid can be terminated by repressurizing the receiving vessel, thereby directing molten fluid in the conduit back into the reactor.

13 Claims, 1 Drawing Sheet

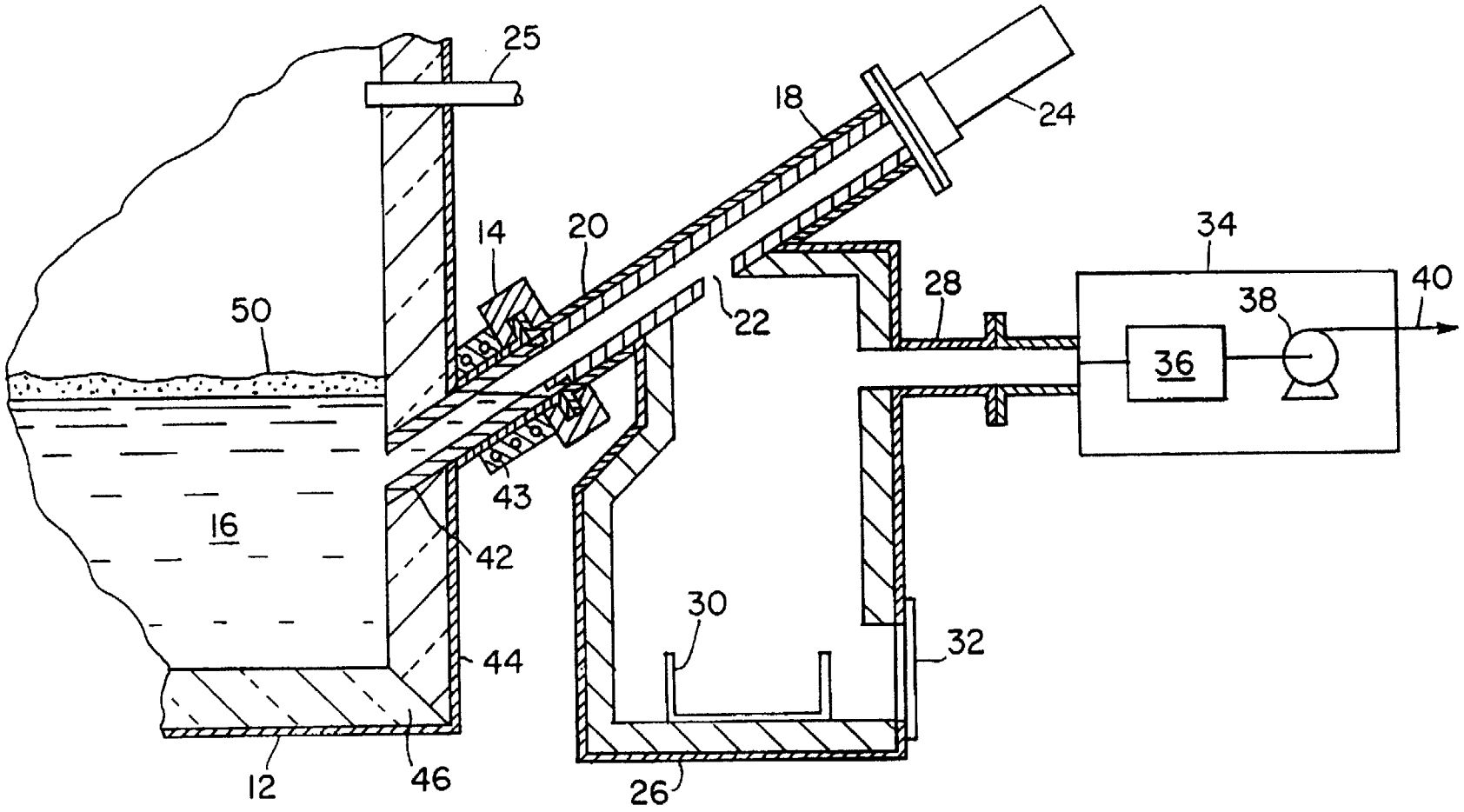
40
38
34
36
24
28
32
18
22
30
26
20
25
14
43
42
44
46
50
16
12

APPARATUS AND METHOD FOR TAPPING A REACTOR CONTAINING A MOLTEN FLUID

BACKGROUND OF THE INVENTION

Disposal of organic wastes in landfills and by incineration has become an increasingly difficult problem because of diminishing availability of disposal space, strengthened governmental regulations, and the growing public awareness of the impact of hazardous substance contamination upon the environment. Release of hazardous organic wastes to the environment can contaminate air and water supplies, thereby diminishing the quality of life in surrounding populations.

More recent attempts to dispose of hazardous wastes include decomposition of toxic compounds and containment of harmful waste constituents in molten metal or molten salt baths. The technology employed is sometimes similar to conventional steelmaking technology. For example, suitable reactors for treatment of hazardous wastes in molten metal baths can include top and bottom-blown basic oxygen process reactors (K-BOP and Q-BOP, respectively), argon-oxygen decarbonization furnaces (AOD), electric arc furnaces (EAF), etc., which have been fitted with a suitable means for top and bottom injection and top charging, such as is known in conventional steelmaking practices.

Whereas conventional ores and scrap metal feedstocks that are generally employed in steelmaking typically have well-known compositions, the compositions of hazardous wastes are highly variable. Therefore, systems that treat such hazardous wastes frequently require closer monitoring of operating conditions than do similar systems which process only conventional ore and scrap metal feedstocks. For example, the composition of molten metal baths can periodically require determination to ensure there has not been contamination or saturation with waste constituents that diminish the effectiveness of such molten metal baths in treating additional wastes.

However, the ability to determine accurately the composition of molten metal baths during use has been limited because handling of molten metals is difficult and often very dangerous. Indirect attempts, on the other hand, such as infrared measurement or analysis based on the composition of gases released by molten metal baths, are generally less accurate than direct measurement of bath compositions.

Also, processing of wastes in molten metal baths often causes accumulation of liquid metal or ceramic material. This material typically requires removal from the reactor on a periodic basis.

Therefore, a need exists for an apparatus and method for tapping reactors containing molten fluids that overcome or minimize the above-referenced problems.

SUMMARY OF THE INVENTION

The present invention relates to an apparatus and a method for tapping a reactor containing a molten fluid.

The apparatus includes a conduit extending from the reactor. Heating means at the conduit heat the conduit to a temperature which causes fluid extracted from the reactor to remain molten while in the conduit. A receiving vessel is at the conduit. Pressure reducing means at the receiving vessel reduces the pressure within the receiving vessel, whereby the molten fluid within the reactor is extracted from the reactor through the conduit and directed into the receiving vessel, thereby tapping the reactor.

The method includes heating a conduit extending from the reactor to a temperature which causes fluid extracted from the reactor to remain molten while in the conduit. Pressure is reduced within a receiving vessel which is at the conduit, whereby molten fluid within the reactor is extracted from said reactor through the conduit and directed into the receiving vessel, thereby tapping the reactor.

This invention has many advantages. For example, a molten fluid, such as a molten metal or a molten salt, can be tapped from a reactor without interruption of reactor processing. Further, distinct phases can be separately sampled according to the location of the apparatus of the invention at the reactor. Also, tapping of a molten metal or a molten slag can be initiated and terminated at will during processing. The rate of tapping can also be controlled by controlling the reduction of pressure within the receiving vessel of the apparatus. Therefore, frequent sampling and, consequently, close monitoring of molten fluid compositions can be achieved. In addition, molten fluids which are tapped by the method and apparatus of the invention are not exposed to the environment. Consequently, there is no direct handling of the molten metal or slag that could endanger operators of the reactor.

BRIEF DESCRIPTION OF THE DRAWING

The FIGURE is a schematic representation of one embodiment of the apparatus of the present invention.

DETAILED DESCRIPTION OF THE INVENTION

The features and other details of the apparatus and method of the invention will now be more particularly described with reference to the accompanying drawing and pointed out in the claims. It will be understood that the particular embodiments of the invention are shown by way of illustration and not as limitations of the invention. The principle features of this invention can be employed in various embodiments without departing from the scope of the invention.

The present invention relates generally to an apparatus and method for tapping a reactor containing a molten fluid. One embodiment of the invention is shown in the FIGURE as apparatus 10. Apparatus 10 is connected to reactor 12 by means of flanged gas-tight coupling 14. Molten fluid 16, such as a molten metal fluid, is disposed within reactor 12.

Apparatus 10 includes conduit 18 with inlet end 20 and outlet end 22. Inlet end 20 of conduit 18 extends from flanged gas-tight coupling 14 at a positive acute angle measured from the horizontal.

Suitable heating means is located at conduit 18. The heating means is capable of providing sufficient thermal energy to heat conduit 18 to a temperature that will cause fluid from reactor 12 to remain molten while in conduit 18. An example of a suitable heating means is plasma element 24, which is mounted within conduit 18. Plasma element 24 can be a plasma torch. Alternatively, plasma element can be employed to form a plasma arc. The plasma arc can be a transferred plasma arc or a non-transferred plasma arc a suitable non-transferred plasma arc is generated at plasma element 24. A suitable transferred plasma arc can be generated by plasma element 24 and plasma terminal 25.

Receiving vessel 26 is attached to outlet end 22 of conduit 18 and includes gas evacuation port 28. Receiving vessel 26 contains mold 30 to hold the molten fluid. Mold 30 can be removed from receiving vessel 26 through access panel 32.

A suitable pressure-reducing means is located at receiving vessel 26. The pressure reducing means is capable of reducing the pressure within receiving vessel 26 creating a differential pressure between reactor 12 and receiving vessel 26 that causes molten fluid 16 within reactor 12 to flow into and through conduit 18 and be directed into receiving vessel 26, thereby tapping reactor 12. An example of a suitable pressure reducing means is differential pressure system 34. Differential pressure system 34 includes heat exchanger 36 and differential pressure pump 38. Discharge 40 from differential pressure system 34 can be returned to a process off-gas recovery system (not shown).

Reactor 12 includes port 42, which extends through reactor shell 44 and its refractory lining 46. Gas-tight coupling 14 is attached to reactor 12 at port 42. It is to be understood that reactor 12 can be fitted with a plurality of ports at various locations in reactor shell 44. Cooling coil 43 at port 42 is suitable for induction cooling at port 42 of molten fluid at port 42 to a temperature that causes molten fluid to accumulate within port 42 and thereby restrict or close the opening at port 42. Cooling coil 43 can be located within refractory lining 46 of reactor 12. All example of a suitable cooling medium for transfer or recirculation through cooling coil 43 is water. By controlling the rate of transfer of cooling medium through cooling coil 43, or by controlling the temperature of the cooling medium, for example, the diameter of the opening at port 42 can be controlled, thereby providing control over the opening, closing, and rate of discharge of molten fluid from reactor 12 through port 42.

In one embodiment, molten fluid 16 includes molten metal layer 48 beneath vitreous layer 50. The liquid level of molten fluid 16 in reactor 12 is about level with port 42. It is to be understood that molten fluid 16 can comprise two or more immiscible molten metal phases.

Conduit 18 and receiving vessel 26 are constructed of suitable materials, as are known in the art, such as steel or a suitable refractory material. One example of a suitable refractory material is a ceramic.

The method of the invention includes heating conduit 18, such as by activating plasma torch 24, to a temperature which causes fluid extracted from reactor 12 to remain molten while in conduit 18. In one embodiment, conduit 18 is heated to a temperature in a range of between about 1370° C. and 1600° C. High-temperature gas from plasma torch 24 bubbles through molten fluid 16 at inlet end 20 of conduit 18, thereby preventing obstruction of port 42 and conduit 18.

To remove a portion of molten fluid 16 from reactor 12, differential pressure system 34 is turned on and plasma torch 24 is turned off. As the pressure is reduced in receiving vessel 26, molten fluid 16 flows into and through conduit 18. Molten fluid 16 is discharged from outlet end 22 of conduit 18 and drops into mold 30 in receiving vessel 26.

To stop tapping molten fluid 16 from reactor 12, differential pressure system 34 is turned off and plasma torch 24 is activated. Activation of plasma torch 24 prevents molten fluid in conduit 18 from cooling and solidifying, thereby sealing conduit 18. Also, activation of plasma torch 24 causes the pressure to increase in receiving vessel 26, thereby directing the molten fluid in conduit 18 back into reactor 12 through port 42. Optionally, a suitable gas, such as an inert gas, can also be directed into receiving vessel 26 to increase the pressure in receiving vessel 26 and conduit 18, thereby directing molten fluid in conduit 18 back into reactor 12. The gas from plasma torch 24 flows through conduit 18 and then bubbles through molten fluid 16 in reactor 12. The high temperature of the plasma gas passing through conduit 18 ensures that it will remain open until the next time reactor 12 is to be tapped.

Panel 32 can then be opened to remove mold 30, containing a portion of the molten fluid, from receiving vessel 26.

Equivalents

Those skilled in the art will recognize, or be able to ascertain using no more than routine experimentation, many equivalents to the specific embodiments of the invention described herein. Such equivalents are intended to be encompassed by the following claims.

What is claimed is:

1. An apparatus for tapping a reactor containing a molten fluid, comprising:

a) a straight conduit extending from the reactor at an acute angle measured from a horizontal surface of the molten fluid;

b) heating means at the conduit for heating the conduit to a temperature that causes fluid extracted from the reactor to remain molten while in the conduit;

c) a receiving vessel at said conduit;

d) pressure reducing means at the receiving vessel for reducing the pressure within said receiving vessel, whereby the molten fluid within the reactor is extracted from said reactor through the conduit and directed into the receiving vessel, thereby tapping the reactor; and e) cooling means at a portion of said conduit most proximate to said reactor, whereby solidification and consequent accumulation of molten fluid within said conduit can be controlled by controlling said cooling means.

2. An apparatus of claim 1, wherein the means for heating the conduit includes a plasma torch.

3. An apparatus of claim 2, wherein the conduit is connected to the reactor by a flanged coupling.

4. An apparatus of claim 3, wherein the conduit is formed of a refractory material.

5. An apparatus of claim 4, wherein the refractory material is a ceramic.

6.An apparatus of claim 1, further including at least one set of molds within the receiving vessel to contain the molten fluid emanating from the conduit.

7. An apparatus of claim 1, wherein the means for heating the conduit includes means for regulating the temperature of the conduit.

8. An apparatus of claim 1, wherein the means for reducing the pressure within the receiving vessel includes means for regulating the pressure within the receiving vessel.

9. An apparatus of claim 1, wherein said cooling means includes a cooling coil.

10. An apparatus of claim 1, wherein the means for heating the conduit includes a non-transferred plasma arc.

11. An apparatus of claim 1, wherein the means for heating the conduit includes a transferred plasma arc.

12. A method for controlling a rate at which a molten fluid is discharged from a reactor, comprising the steps of:

a) heating a straight conduit, said conduit extending from the reactor at an acute angle measured from a horizontal surface of the molten fluid, to a temperature that causes at least a portion of fluid extracted from the reactor to remain molten while in the conduit;

b) creating a differential pressure between the reactor and a receiving vessel that is at the conduit, whereby extraction of said molten fluid from the reactor through the conduit into the receiving vessel is controlled by controlling heating of said conduit and controlling said differential pressure; and cooling a portion of said conduit most proximate to said reactor, thereby further controlling extraction of said molten fluid from the reactor by controlling solidification of the molten fluid and consequent accumulation of material within said conduit.

13. A method for controlling a rate which a molten fluid is discharged from a reactor, comprising the steps of:

a) heating a straight conduit, said conduit extending from the reactor at an acute angle measured from a horizontal surface of the molten fluid, to a temperature that causes at least a portion of fluid extracted from the reactor to remain molten while in the conduit;

b) creating a differential pressure between the reactor and a receiving vessel that is at the conduit, whereby molten fluid is extracted from said reactor through the conduit and directed into the receiving vessel; and c) cooling a portion of said conduit most proximate to said reactor, thereby controlling extraction of said molten fluid from the reactor by controlling solidification of the molten fluid and consequent accumulation of material within said conduit.

* * * * *